US008875325B2

(12) United States Patent
Sloan

(10) Patent No.: US 8,875,325 B2
(45) Date of Patent: Nov. 4, 2014

(54) GRAPHIC SWADDLING BEDDING SET

(71) Applicant: Christopher Robert Sloan, Bothell, WA (US)

(72) Inventor: Christopher Robert Sloan, Bothell, WA (US)

( * ) Notice: Subject to any disclaimer, the term of this patent is extended or adjusted under 35 U.S.C. 154(b) by 0 days.

(21) Appl. No.: 13/623,808

(22) Filed: Sep. 20, 2012

(65) Prior Publication Data

US 2013/0067660 A1 Mar. 21, 2013

Related U.S. Application Data

(60) Provisional application No. 61/536,608, filed on Sep. 20, 2011.

(51) Int. Cl.

| | |
|---|---|
| ***A47G 9/04*** | (2006.01) |
| ***A47D 15/02*** | (2006.01) |
| ***A47G 9/02*** | (2006.01) |
| ***A47G 9/08*** | (2006.01) |

(52) U.S. Cl.

CPC *A47D 15/02* (2013.01); *A47G 9/02* (2013.01); *A47G 9/083* (2013.01)

USPC ..... 5/494; 5/413 R; 5/498

(58) Field of Classification Search

USPC ..... 5/494, 498, 655, 485, 486, 502, 413 R

See application file for complete search history.

(56) References Cited

U.S. PATENT DOCUMENTS

| | | | | |
|---|---|---|---|---|
| 2,419,989 A | | 5/1947 | Day | |
| 2,961,668 A | | 11/1960 | Hayes | |
| 3,060,462 A | | 1/1961 | Miller | |
| 3,121,885 A | | 2/1964 | Cherry | |
| 3,521,309 A | * | 7/1970 | Evans | 5/494 |
| 3,579,675 A | | 5/1971 | Scheer | |
| 3,857,124 A | | 12/1974 | Hadley | |
| 4,062,076 A | | 12/1977 | Albertson | |
| 4,413,368 A | | 11/1983 | Schuetze | |
| 4,442,558 A | | 4/1984 | Alexander | |
| 4,458,372 A | | 7/1984 | Mills | |
| 4,590,633 A | | 5/1986 | Pickens | |
| 4,734,948 A | | 4/1988 | Danova | |
| 4,972,533 A | * | 11/1990 | Brown | 5/413 R |
| 5,093,947 A | * | 3/1992 | Henegar et al. | 5/482 |
| D328,665 S | | 8/1992 | McNaughton | |
| 5,421,045 A | | 6/1995 | Bowen | |
| 5,515,559 A | | 5/1996 | Benson | |
| 5,933,886 A | | 8/1999 | Washington | |
| 6,513,164 B1 | * | 2/2003 | Hearns | 2/69.5 |
| 7,337,481 B2 | * | 3/2008 | Gilbert | 5/494 |

(Continued)

*Primary Examiner* — Peter M Cuomo
*Assistant Examiner* — Brittany Wilson
(74) *Attorney, Agent, or Firm* — Dean A Craine

(57) ABSTRACT

A graphic swaddling bedding set that includes a bottom sheet for a mattress with a designated sleeping area located centrally and longitudinally thereon. Formed or attached to the designated sleep area is a selectively attached, pouch configured for containing the body of a child when longitudinally aligned therein when sleeping. The top edge of the pouch is detached thereby forming a top opening. Disposed over the bottom sheet and extending transversely over the pouch is a double wing-shaped top cover. Disposed between the top surface of the pouch and the bottom surface of the top cover is at least one hook and loop connector that connects the pouch and top cover. The top cover configured to extend over the sides of the mattress. Connectors or weights may be to hold the corners and lateral edges of the top cover pull the top cover tightly and hold it in place.

9 Claims, 6 Drawing Sheets

(56) References Cited

U.S. PATENT DOCUMENTS

| | | | | |
|---|---|---|---|---|
| 7,383,598 | B2 | 6/2008 | Titcomb | |
| 7,818,833 | B2 | 10/2010 | Ewing | |
| 8,276,224 | B1 * | 10/2012 | von Yurt et al. | 5/494 |
| 2008/0184486 | A1 * | 8/2008 | Byrne et al. | 5/494 |
| 2010/0251482 | A1 | 10/2010 | MacDonald | |

* cited by examiner

GRAPHIC SWADDLING BEDDING SET

This utility patent application is based on and claims the filing date benefit of U.S. provisional patent application (Application No. 61/536,608) filed on Sep. 20, 2011.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to sheets and blankets for a bed, and more particularly to sheets and blankets used on a child's bed to keep them tucked in the bed while sleeping.

2. Description of the Related Art

At bedtime, parents often spend a few moments comforting and tucking their small child into bed. Often, they discuss topics that are particularly interesting to a small child, such as toy, or cartoon superheroes, or animals. Many of these heroes have wings that enable them to fly and carry out ordinary or extraordinary tasks.

When tucking a child into the bed at night, the top sheet, blankets and bed cover are temporarily pulled back so that the child may lay longitudinally over the bottom sheet and position his or her head on the pillow. The parent then pulls the blankets and bed cover upward to the child's shoulders or chin. Because some small children toss and turn in the bed when sleeping and dislodge the blankets and bed covers, many parents tuck the corners and side edges of the blankets and bed covers under the mattress.

To simulate swaddling, many parents pull the blankets and bed cover tightly over the child and then tuck the corners and sides under the mattress to hold the blankets and bed cover tightly over the child. Unfortunately during the night, the edges and corners of the blankets and bed cover become loose and the child may wake up because he or she is cold. The parent often has to tuck the child back in bed and swaddle the blanket and bed cover again.

What is needed is a bedding set for a small child's bed that swaddles the child while lying in bed, is not easily dislodged by the child at night when sleeping, and simulates a winged toy, a superhero or an animal.

SUMMARY OF THE INVENTION

It is an object of the present invention to provide a graphical swaddling bedding set which includes a bottom sheet with a designated sleeping area located centrally and longitudinally thereon. In one embodiment, the designated sleeping area may be covered by a soft sleeping layer. Aligned and registered over the designated sleeping area is a detachable pouch. The pouch may be an elongated sleep bag structure or elongated blanket attached along one or two perimeter side edges and along a bottom edge to the top surface of the bottom sheet that surround the designated sleeping area. The top edge of pouch is detached thereby forming a top opening. One or more side edges of the pouch may also detached or attached with a temporary attachment means, such as a zipper or hook and loop connects that allow ingress and egress from the pouch.

Disposed over the pouch and extending across the bottom sheet is a wing simulating top cover. The wing simulated top cover is a transversely aligned, hour glass appearing structure with two lateral side wing sections joined together at a narrow middle section. The top cover is centrally aligned over the pouch so that the child's head and the lower section of the pouch is exposed when sleeping in the pouch. In one embodiment, the top cover is sufficient in width so that the four corners or tips of the wing sections hang over the sides of the mattress. If desired, the tips may be tucked under the mattress to pull the top cover tightly over the child to swaddle the child and to hold it in place during the night. In another embodiment, the weights may be added or attached to the tips or corners or to the lateral perimeter edges of the top cover. In still another embodiment, complimentary connectors may be attached to the tips or corners of the top cover and to the top surface of the bottom sheet that when engaged, hold the top cover tightly over the child and in a fixed position.

Located between the top surface of the pouch and the bottom surface of the top cover is a means for temporary attaching the top cover to the pouch.

When the bottom sheet, the pouch cover and the top cover are aligned and registered over the mattress, they create a two dimensional graphic image of a superhero, a fictitious creature or an animal. Each component includes a graphic element which are combined with the other graphic elements on the other structures or surfaces, to form a complete two dimensional graphic image of a superhero, fictitious creature or animal. In one embodiment, a pillow case is included in the bedding set with a head graphic element of the superhero or creature printed on one s surface. When the bed is made, the pillow is rotated so that the head graphic element is visible. The opposite surface of the pillow may include a second head graphic to provide more variety, or include no head graphic element so that when the pillow case is turned over, the child's head becomes the head of the superhero, creature or animal.

DESCRIPTION OF THE PREFERRED EMBODIMENT(S)

Figure 1:
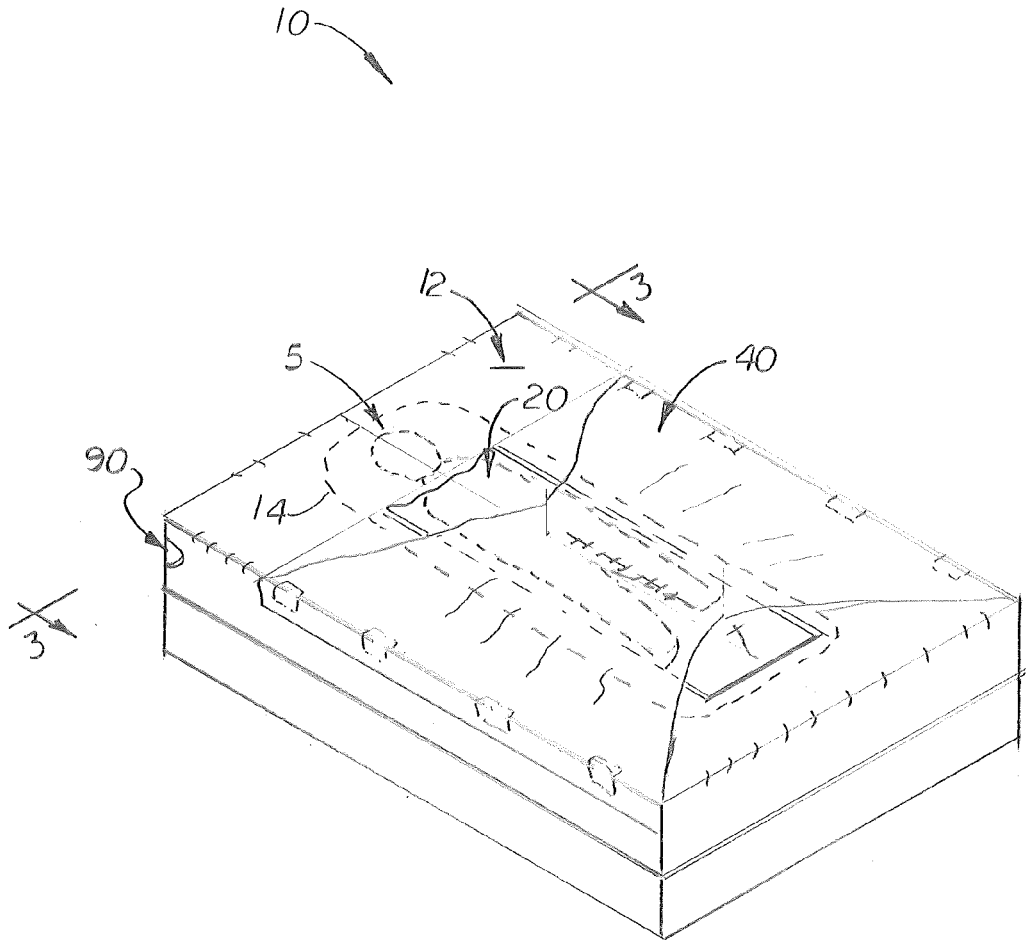
FIG. 1 is a top perspective view of a bed with the child's bedding used thereon.

Referring to the accompanying FIGS. 1-6, there is shown a graphic swaddling bedding set 10 to be used on a standard toddler, twin, double, queen, or king size mattress 90 designed to swaddle and securely hold a child 5 while lying longitudinally on the mattress 90 when sleeping. The bedding set 10 is also designed to resist detachment caused by movement of the child 5 when sleeping. Further, the bedding 10 is designed to appeal to a small child's interest in toy, or cartoon superheroes, fictitious creatures or animals.

The bedding set 10 a bottom sheet 12 designed to cover and fit over the mattress 90. Formed on the bottom sheet 12 is a central, longitudinally aligned designated sleeping area 14. Disposed over the designated sleeping area is a pouch 20.

Figure 2:
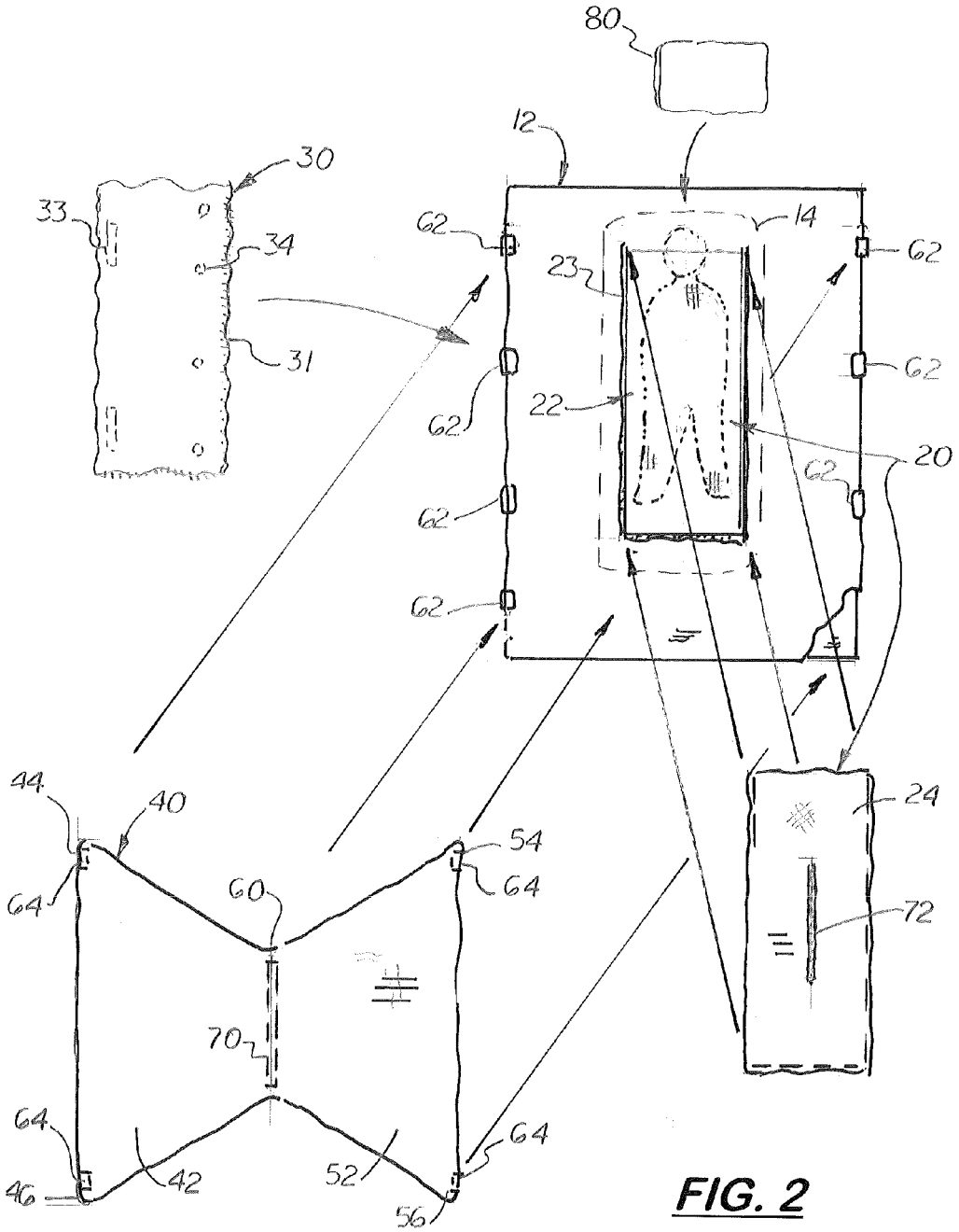
FIG. 2 is a top plan view of a mattress with the bottom sheet, the pouch cover, and the top cover being assembled thereon.
Figure 3:
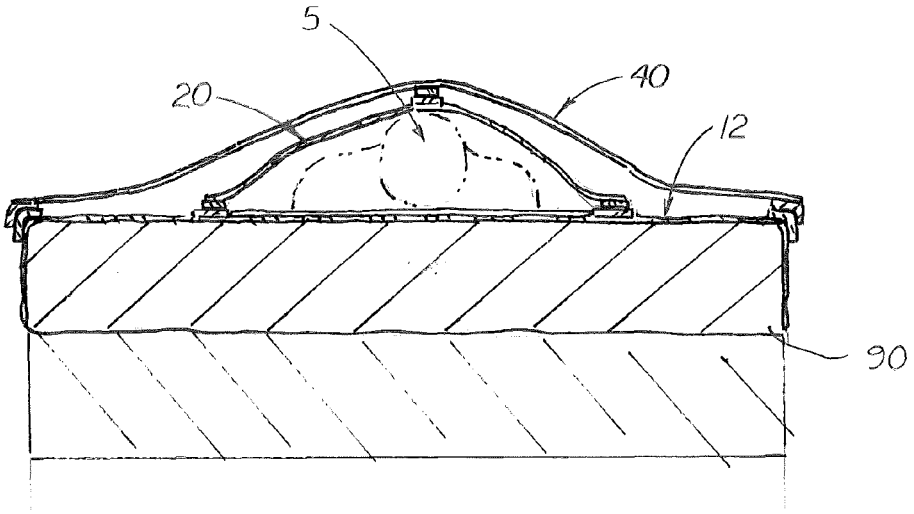
FIG. 3 is sectional view taken along line 3-3 in FIG. 1.

As shown in FIG. 2, the pouch 20 may include a lower pouch layer 22 attached to the top surface of the bottom sheet 12 and over the designated sleeping area 14 and an upper blanket 24 aligned and registered over the lower pouch layer 22. The side edges and the bottom edges of the lower pouch layer 22 and the upper blanket 24 may be securely or selectively attached. The perimeter edges 23 of the lower pouch layer 22 may be permanently or selectively attached to the top surface of the bottom sheet 12.

The lower pouch layer 22 and the upper blanket 24 may be replaced by a sleeping bag 30. In one embodiment the sleeping bag 30 includes a side zipper 31 that extends along one side edge and along the bottom edge. The opposite side edge may be detached thereby allowing the child to easily ingress and egress the sleeping bag 30. The bottom layer of the sleeping bag 30 may include hoop and loop connectors 33 or snaps 34 that connect to complimentary hook and loop connectors or snaps (not shown) on the bottom sheet 12 to hold the sleeping bag 30 in place. In both embodiments, a pouch 20 is formed that is sufficient in width and length to accommodate a small child 5.

Disposed over the pouch 20 and extending across the bottom sheet 12 is a wing simulating top cover 40. The wing simulated top cover 40 is a transversely aligned, hour glass appearing structure with two lateral side wing sections 42, 52 joined together at a narrow middle section 60. The top cover 40 is centrally aligned over the pouch 20 so that the child's head and the lower section of the pouch 20 are exposed when sleeping in the pouch 20. In one embodiment, the top cover 40 is sufficient in width so that the four corners 44, 46 and 54, 56, of the wings sections 42, 52, respectively, extend and hang over the sides of the mattress 90. If desired, the corners 44, 46, 54, 56 may be tucked under the mattress 90 to pull the top cover 40 tightly over the child to swaddle the child and to hold it in place during the night. In another embodiment, the weights 70 (see FIG. 6) may be added or attached to the lateral perimeter edges 47, 48, or to one or more pockets 49 on the top cover 40. The weights 70 must be sufficient to pull the perimeter edges or corners downward so that the top cover 40 is tightly stretched across the pouch 20 and the bottom sheet 12. In still another embodiment, complimentary connectors 62, 64, may be attached to the edges or corners of the top cover 40 and the side edges of the bottom sheet 12, respectively, that when engaged, hold the top cover 40 tightly over the child 5 and in a fixed position.

Located between the top surface of the pouch 20 and the bottom surface of the top cover 40 is a means for temporary attaching the top cover 40 to the pouch 20. In the preferred embodiment, the means for attaching are hook and loop connectors 70, 72, respectively. It should be understood that the hook and loop connectors 70, 72 are used as examples of suitable connectors and that other types of connectors, such as snap button connectors, may be used.

Figure 4:
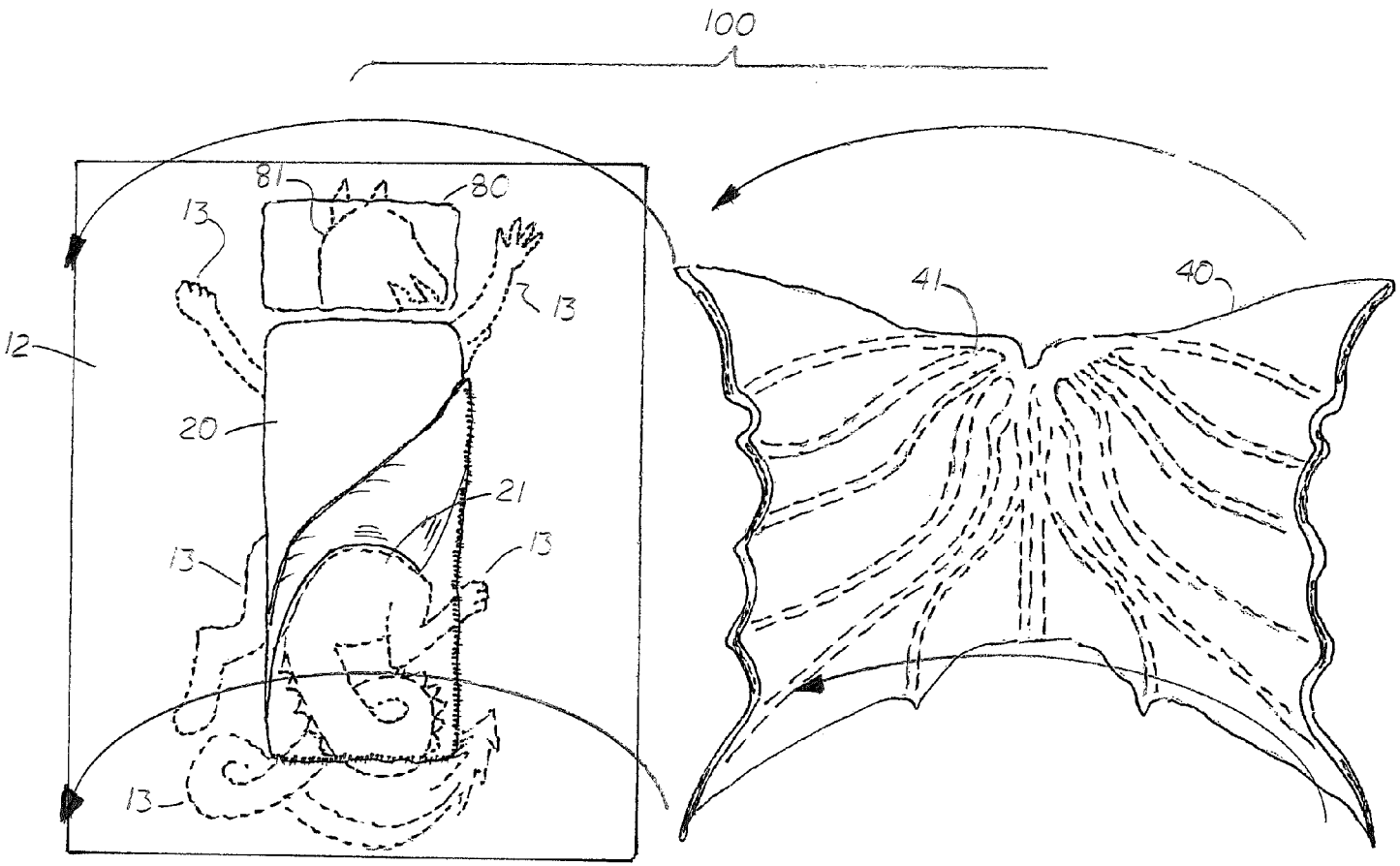
FIG. 4 is an illustration that shows the top plan view of the bedding set being installed on a mattress showing the various graphic elements on the bottom sheet, the pouch cover, the top cover, and the pillow.
Figure 5:
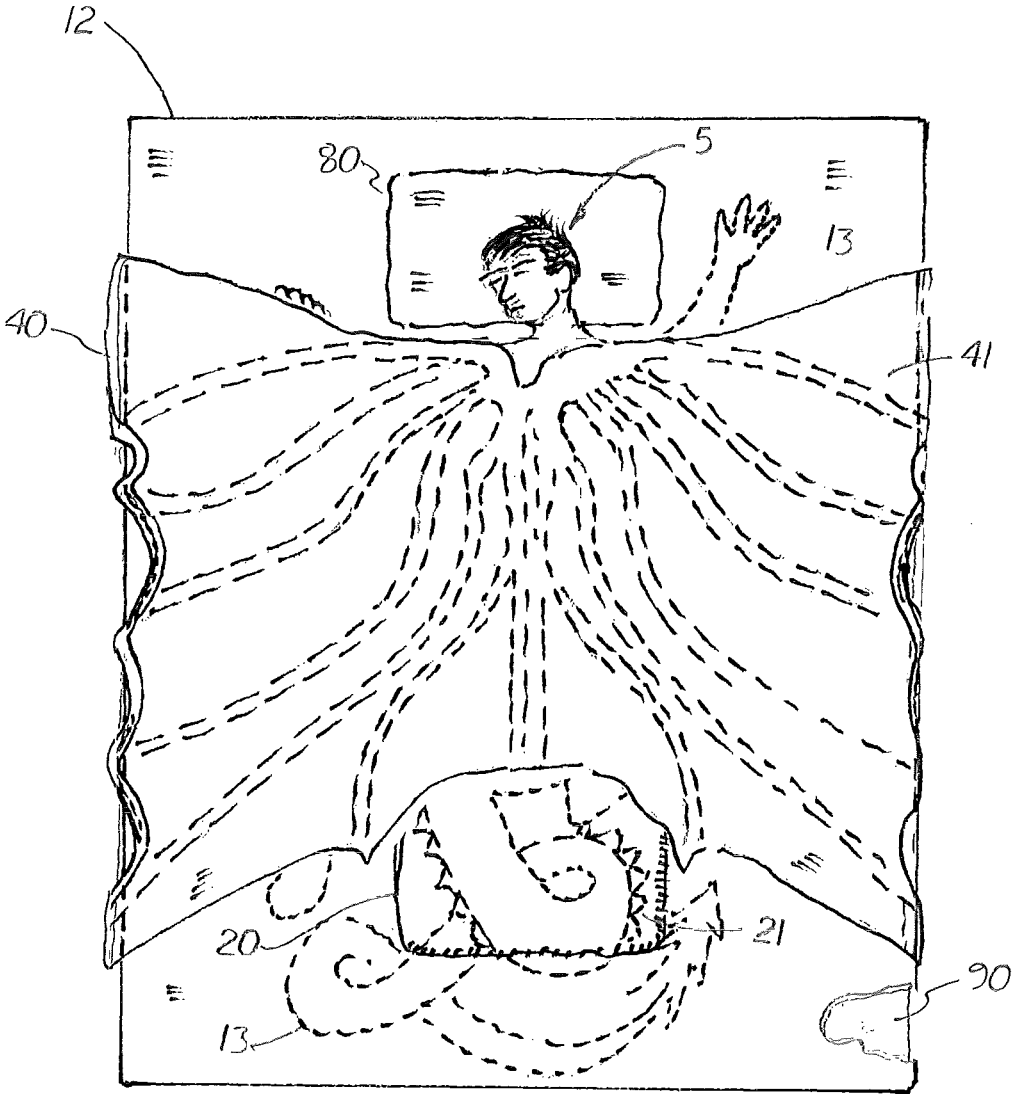
FIG. 5 is a top plan view of the bedding set assembled on a mattress and showing a small child resting his head on the top surface of the pillow that has been rotated thereby simulating the small child is the superhero or creature.
Figure 6:
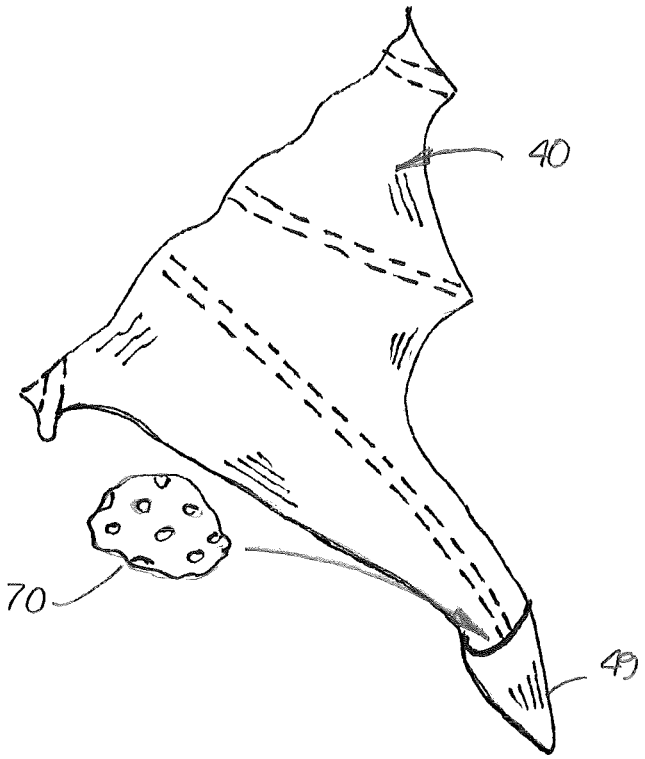
FIG. 6 is a top plan view of a corner of the top cover that includes a pocket that receives a weight.

When the bottom sheet 12, the pouch 20 and the top cover 40 are aligned and registered over the mattress 90, they can create a two dimensional graphic image of a toy, superhero, animal or creature, generally referred to as 100 as shown in FIGS. 4 and 6. The bottom sheet 12, the pouch 20 and the top cover 40 includes one or more graphic elements 13, 21, and 41, respectively, which when the bedding set 10 is installed over the mattress 90, forms the complete 2 dimensional graphic image 100 of a superhero or creature as shown in FIGS. 4 and 5. It should be understood that the graphic image 100 depicting a dragon with wings is provided as one type of a graphic image that may be used and that the invention is not limited to this particular superhero, or creature. An graphic image is possible. The inventive concept is that the bottom sheet 12, pouch 30 and the top cover 40 all include graphic elements that when installed properly on a mattress, form a complete graphic image.

In one embodiment, the bedding set 10 includes a pillow case 80 with a head graphic element 81 of the superhero or creature printed on one surface. When the mattress 90 is made, the pillow 80 is rotated is that the head graphic element 81 is visible when positioned on the mattress 90 adjacent to the middle region of the top cover. The opposite surface of the pillow 80 may include a second head graphic (not shown) to provide more variety, or may include no head graphic element as shown in FIG. 2 so that when the pillow case 81 is turned over, the child's head when positioned adjacent to the middle region of the top cover 40 becomes the head of the superhero or creature.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A bedding set for a child, comprising:

a. a bottom sheet that fits over a mattress, said bottom sheet includes a designated sleeping area located centrally and longitudinally thereon;

b. a pouch disposed over said designated sleep area on said bottom sheet, said pouch includes a pouch cover with two perimeter edges attached to said bottom sheet surrounding said designated sleep area, said pouch cover includes a top opening that exposes the head of a child when sleeping over said designated sleep area and under said pouch cover, said pouch cover also being sufficient in width and length to cover the body of a child and restrain the child when laying over said designated sleeping area, said pouch includes a side opening that enables a child laying in said designated sleeping area to ingress and egress laterally from said pouch;

c. a double wing-shaped top cover configured to extend across said bottom sheet and at least partially cover said pouch cover; and d. wherein said pouch cover and said double wing-shaped top cover include graphic elements that form a large graphic image when assembled on a mattress.

2. The bedding set, as recited in claim 1, wherein said bedding set includes a pillow case.

3. The bedding set as recited in claim 1, wherein said top cover selectively connects to said bottom sheet.

4. The bedding set as recited in claim 1, wherein said top cover includes four corners that extend and hang over the sides of the mattress.

5. The bedding set as recited in claim 1 wherein said pouch is a detachable sleeping bag.

6. The bedding set as recited in claim 1, wherein said graphic image is the image of a winged creature.

7. A bedding set for a child, comprising:

a. a bottom sheet that fits over a mattress, said bottom sheet includes a designated sleeping area located centrally and longitudinally thereon;

b. a pouch disposed over said designated sleep area on said bottom sheet, said pouch includes a pouch cover with two perimeter edges attached to said bottom sheet surrounding said designated sleep area, said upper top layer includes a top opening that exposes the head of a child when sleeping over said designated sleep area and under said upper top layer, said upper top layer also being sufficient in width and length to cover the body of a child and restrain the child when laying over said designated sleeping area;

c. a double wing-shaped top cover configured to extend across said bottom sheet and at least partially cover said pouch cover, said top cover includes four corners that extend and hang over the sides of the mattress with weights located in said corners configured to apply a stretching force on said top cover sufficient to swaddle a child placed over said designated sleep area and inside said pouch; and d. wherein said pouch cover and said top cover include graphic elements that form a large graphic image when said pouch cover and said top cover are assembled over the mattress.

8. The bedding set as recited in claim 7, wherein said top cover selectively connected to said bottom sheet with hook and loop connectors.

9. A bedding set for a child, comprising:

a. a bottom sheet that fits over a mattress, said bottom sheet includes a designated sleeping area located centrally and longitudinally thereon;

b. a pouch disposed over said designated sleep area on said bottom sheet, said pouch includes a pouch cover with two perimeter edges attached to said bottom sheet surrounding said designated sleep area, said pouch cover includes a top opening that exposes the head of a child when sleeping over said designated sleep area and under said pouch cover, said pouch cover also being sufficient in width and length to cover the body of a child and restrain the child when laying over said designated sleeping area, said pouch includes a side opening that enables a child laying in said designated sleeping area to ingress and egress laterally from said pouch;

c. a top cover configured to extend across said bottom sheet when fitted over the mattress and at least partially cover said pouch cover; and, d. wherein said pouch cover and said top cover include graphic elements that form a larger graphic image that when assembled on a mattress.

* * * * *